US007621534B2

(12) United States Patent
Hui

(10) Patent No.: US 7,621,534 B2
(45) Date of Patent: Nov. 24, 2009

(54) METHOD OF CONDUCTING A CARD GAME

(75) Inventor: Victor Hui, Macau (CN)

(73) Assignee: Masterwork Group Limited, Tortola (VG)

( * ) Notice: Subject to any disclaimer, the term of this patent is extended or adjusted under 35 U.S.C. 154(b) by 324 days.

(21) Appl. No.: 11/649,405

(22) Filed: Jan. 3, 2007

(65) Prior Publication Data

US 2008/0157472 A1 Jul. 3, 2008

(51) Int. Cl.
*A63F 1/00* (2006.01)

(52) U.S. Cl. ..... 273/292; 273/309; 463/12

(58) Field of Classification Search ..... 273/292, 273/274, 309; 463/12, 13
See application file for complete search history.

(56) References Cited

U.S. PATENT DOCUMENTS 5,072,946 A * 12/1991 Miller ..... 273/292
5,895,047 A * 4/1999 Callahan ..... 273/292
6,237,917 B1 * 5/2001 Timpano ..... 273/292
6,488,284 B2 * 12/2002 Webb ..... 273/274
6,776,415 B2 * 8/2004 Robinson et al. ..... 273/292
2004/0090004 A1 * 5/2004 Dreaper et al. ..... 273/292
2008/0036151 A1 * 2/2008 Schugar ..... 273/292

* cited by examiner

*Primary Examiner*—Gene Kim
*Assistant Examiner*—Joseph B Baldori
(74) *Attorney, Agent, or Firm*—Robert Ryan Morishita; Morishita Law Firm, LLC

(57) ABSTRACT

A wager is received on a designated hand. At least two hands are dealt. Optionally, if a hand has a natural hand score, wagers on the hand with the natural hand score may be rewarded. A hand score (the sum modulo ten of the values of the cards) is calculated for each hand and compared to a target value. A card is dealt to the hand further from the target value and a new hand score is calculated for that hand. If the new hand score remains further from the target value than the other hand, wagers on that hand are collected and wagers on the hand closer to the target value are rewarded. If the new hand score is closer to the target value than the other hand, a card is dealt to the hand further from the target value. Hand scores are re-calculated and wagers resolved.

21 Claims, 3 Drawing Sheets

METHOD OF CONDUCTING A CARD GAME

FIELD OF THE INVENTION

The present invention relates to wagering games. More specifically, the present invention is a method for conducting a card game in which players designate a hand and players wagering on the winning hand are rewarded.

BACKGROUND OF THE INVENTION

A well known casino game is Baccarat. Baccarat is a live table game that uses a standard deck of fifty-two playing cards. The object of Baccarat is for a player to successfully wager on which of two hands, designated the Banker hand and the Player hand, is going to win. The player is paid even money for the wager if he or she wagers on the winning hand and loses the wager if he or she selects the losing hand.

Play of Baccarat is commenced after all wagers are made by dealing two cards to the Bank position and two cards are dealt from the shoe to the Player position on the table layout. The cards are turned face up and the values of the Banker hand and the Player hand is determined by summing the face values of the cards in each hand. If the values of the cards are added together and the total of the hand exceeds nine, then the hand value is determined modulo ten. In other words, all hand values range from a low of zero to a high of nine. For example, a seven and an eight total fifteen, but the hand value is five. An Ace and a nine total ten, but the hand value is zero. Whichever of the Banker hand or the Player hand is closest to a total of nine is the winner.

Depending on the point total of the initial Player hand and the initial Banker hand, one more card may be dealt to the Player hand, the Banker hand or both. If either or both of the initial two card Player hand and the initial Banker hand have a point total of 8 or 9, the wagers are resolved without dealing any additional cards: the Player hand wins if the Player hand point total is greater than the Banker hand point total; and the Banker hand wins if the Banker hand point total is greater than the Player hand point total. If both the Player hand and Banker hand have a point total that is less than 8, a third card may be dealt to one or both of the Player hand and/or Banker hand. The rules for determining whether a third card is dealt are fixed; that is, there is no discretion for either the Player hand or the Banker hand on whether a third card is dealt.

Rule #1: If the initial two card Player hand has a point total of 0, 1, 2, 3, 4 or 5, the Player hand draws a third card. If the initial two card Player hand has a point total of 6 or 7, the Player hand stands and does not receive a third card.

Rule #2: If the Player hand stands and does not draw a third card, then the Banker hand follows Rule #1. In other words, if the Player hand has a point total of 6 or 7, the Banker hand draws a third card on a point total of 0, 1, 2, 3, 4 or 5 and the Banker hand stands on a point total of 6 or 7.

Rule #3: If the Player hand draws a third card, the Banker hand must draw or stand as follows:

| Banker hand two card point total: | Banker hand DRAWS when Player's hand third card is: | Banker hand STANDS when Player's hand third card is: |
|---|---|---|
| 0, 1, or 2 | Bank always draws | |
| 3 | 0, 1, 2, 3, 4, 5, 6, 7 or 9 | 8 |
| 4 | 2, 3, 4, 5, 6 or 7 | 0, 1, 8 or 9 |
| 5 | 4, 5, 6 or 7 | 0, 1, 2, 3, 8 or 9 |

-continued

| Banker hand two card point total: | Banker hand DRAWS when Player's hand third card is: | Banker hand STANDS when Player's hand third card is: |
|---|---|---|
| 6 | 6 or 7 | 0, 1, 2, 3, 4, 5, 8 or 9 |
| 7 | | Bank always stands |

At the end of each hand, winning wagers are paid and losing wagers are collected by the house. Any commission due to the house is marked in commission boxes in the center of the table.

As may be appreciated, one characteristic of Baccarat is the complicated draw rules. Thus, there is a need in the art for a new card game in which players designate a hand and players wagering on the winning hand are rewarded.

SUMMARY OF THE INVENTION

The present invention includes a method of conducting a card game using playing cards for at least one player. A method according to the present invention includes receiving a wager from each player and a designation of the hand on which the wager is placed.

At least two hands of playing cards are dealt. In an optional embodiment, two hands, each containing two playing cards, are dealt. A hand score is calculated for each hand by taking the sum modulo ten of the values of the playing cards in that hand. That is, if the sum exceeds ten, the hand score is the ones digit of the sum, with the tens digit disregarded.

In an optional embodiment, at least one natural hand score is defined. For example, in one optional embodiment, two natural hand scores, eight and nine, are defined. If only one of the hand scores is a natural hand score, wagers on the hand having a natural hand score are rewarded and wagers on the hand not having a natural hand score are collected. If more than one of the hand scores is a natural hand score and one of the natural hand scores are different, rewarding the higher ranking natural hand score and collecting wagers on the lower ranking natural hand score. In one optional embodiment, natural hand scores are ranked by proximity to the target value. In such an optional embodiment, wagers on the hand having a natural hand score closer to the target value are rewarded and wagers on the hand having a natural hand score further from the target value are collected. If more than one of the hand scores is a natural hand score and the natural hand scores are equal, all wagers on those hands are returned.

In an optional embodiment, if each hand score for the hands is less than a predetermined value, at least one additional card is dealt to each hand. For example, if each hand score is between zero and two, inclusive, an additional card or additional cards, depending on the embodiment, may be dealt to each hand. A new hand score is calculated for each said hand and the new hand scores are compared to the target value. Wagers on the hand having a hand score closer to the target value may be rewarded, and wagers on the hand having a hand score further from the target value may be collected.

The hand scores of the hands are compared to one another and to a target value. If the hand scores are equal, the game could be resolved in at least two different manners. In an optional embodiment, the tie is resolved as a push and all wagers on the tied hands are returned. In another optional embodiment, an additional card is dealt to each tied hand. A new hand score is calculated for each hand and the new hand scores are compared to one another and to the target value. Wagers are collected on the hand with the new hand score further from the target value and wagers are rewarded on the hand with the new hand score closer to the target value.

Returning to the initial comparison, if one of the hand scores is further from the target value than is the other hand score, an additional card is dealt to the hand having the hand score further from the target value. A new hand score is calculated for the hand to which the card was dealt and the hand scores of the hands are again compared to one another and to the target value.

If the new hand score remains further from the target value than the hand score for the other hand, wagers on the hand with the hand score further from the target value are collected and wagers on the hand with the hand score closer to the target value are rewarded.

Conversely, if the new hand score is closer to the target value than is the hand score for the other hand, an additional card is dealt to the hand having the hand score further from the target value. A new hand score is calculated for the hand to which the card was dealt and the hand scores are again compared to one another and the target value. Wagers on the hand with the hand score further from the target value are collected and wagers on the hand with the hand score closer to the target value are rewarded.

In an optional embodiment, a circumstance in which the new hand score is equal to the hand score for the other hand could be handled in many different ways. In one optional embodiment, a push occurs and all wagers are returned. In another optional embodiment, if the new hand score is equal to the hand score for the other hand, an additional card is dealt to the other hand, i.e. the hand that did not previously receive an additional card. A new hand score is calculated for the other hand and the new hand scores for the previously tied hands are compared. Wagers on the hand with the new hand score further from the target value are collected and wagers on the hand with the new hand score closer to the target value are rewarded.

In an optional embodiment, rewards are based on the wager, minus a commission. In one such optional embodiment, the commission is a percentage of the reward that varies based on the hand score closer to the target value.

DESCRIPTION

Figure 1:
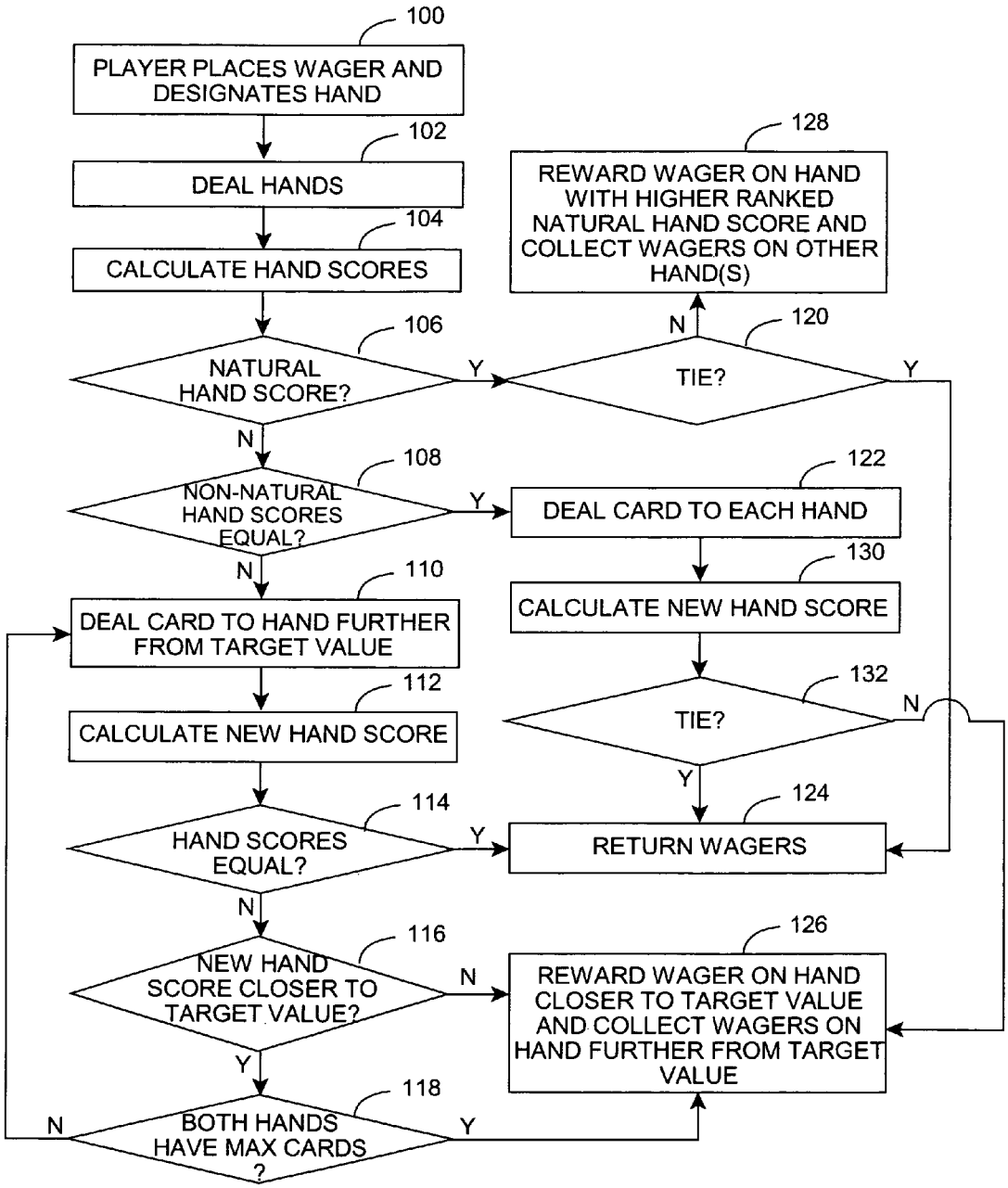
FIG. 1 is a flowchart of a method according to an embodiment of the present invention.
Figure 2:
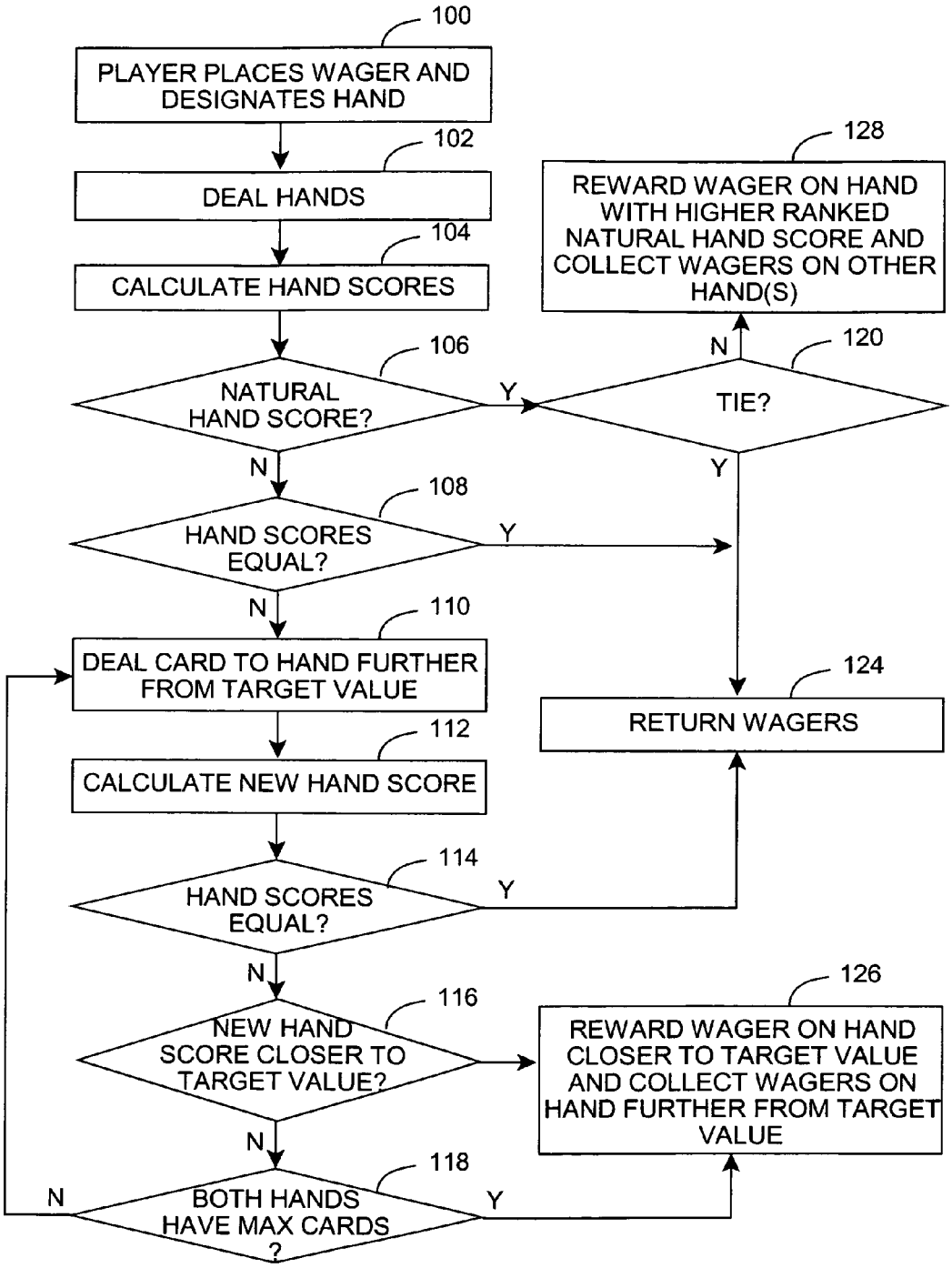
FIG. 2 is a flowchart of a method according to an embodiment of the present invention.
Figure 3:
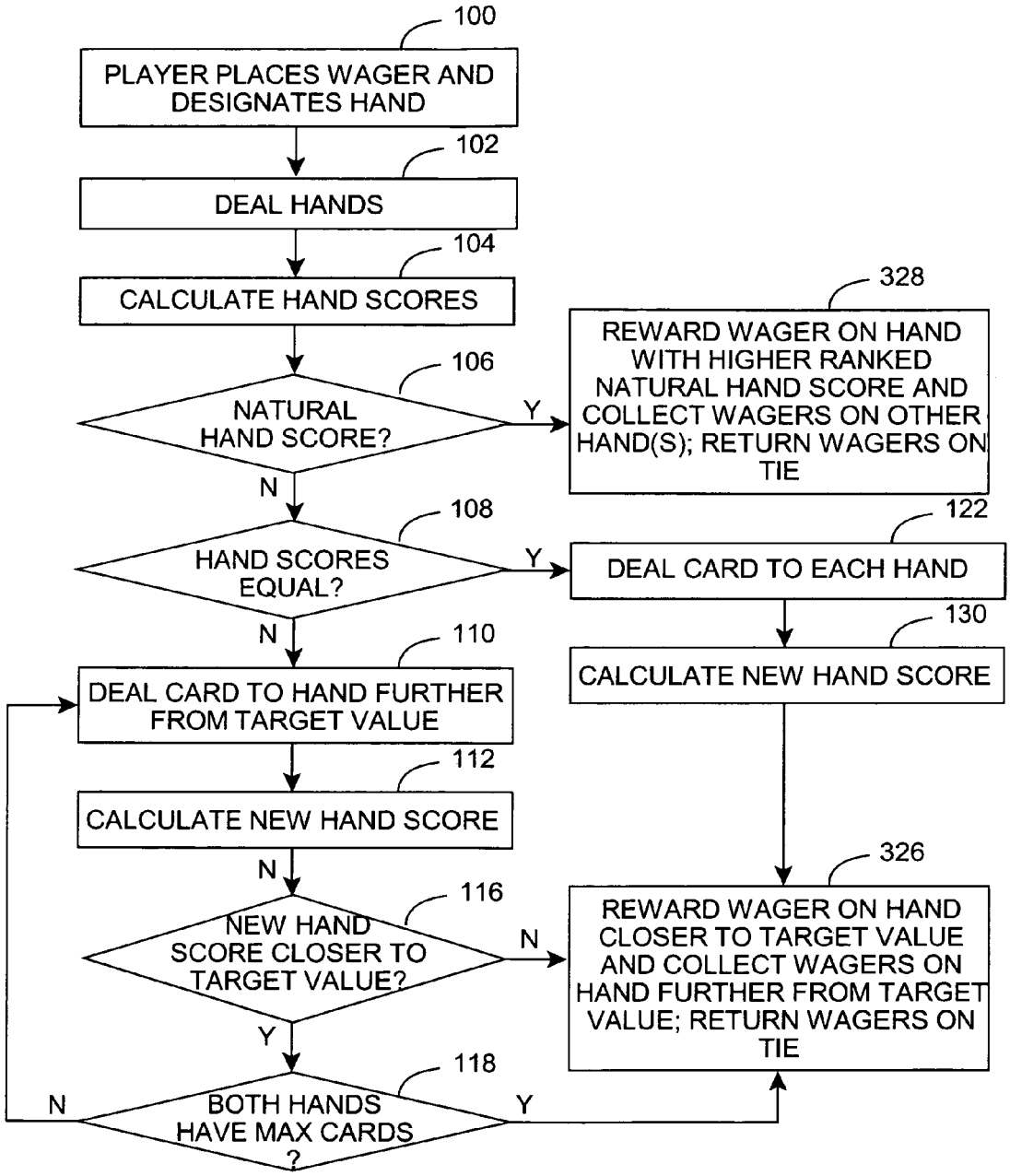
FIG. 3 is a flowchart of a method according to an embodiment of the present invention.

Reference is now made to the figures wherein like parts are referred to by like numerals throughout. Referring generally to FIGS. 1-3, the present invention is directed to a method for conducting a wagering game, particularly a card game. In this regard, a method according to the present invention could be conducted using conventional playing cards, that is, playing cards having a rank of two through ten, Jack, Queen, King, or Ace in four different suits, or customized playing cards. Similarly, the present game could be conducted using one or more decks of conventional fifty-two card constitution, one or more supplemented decks (for example, decks including additional playing cards such as Jokers), one or more truncated decks (for example, Spanish decks lacking playing cards typically found in conventional decks), or the like. In the examples discussed below, the game is conducted using eight conventional decks of playing cards, with the playing cards contained in a card shoe.

The present game is conducted for one or more players. A game according to the present invention could be house-banked, in that the wagers are collected and paid by a game operator, or player-banked, in that the wagers are collected and paid by a player-banker. In an optional embodiment in which the game is player-banked, the role of player-banker may be fixed or rotate among players.

In an optional embodiment, the player places a wager and designates 100 a hand on which the wager is placed. For example, in one optional embodiment, two hands may be dealt, an "A" hand and a "B" hand, and the player places the wager by designating whether the wager is on the "A" hand or the "B" hand. It should be noted that while the examples given below are directed to an embodiment in which two hands are wagered upon and conducted, any number of hands may be wagered upon and conducted in other optional embodiments. In an optional embodiment, additional wagering options, such as wagering on a tie between hands or a pair appearing in a hand, may be offered. It is contemplated that proposition wagers may be rewarded at greater than even money, such as 8:1 for a tie and/or 11:1 for a pair, in such an optional embodiment.

The hands are dealt 102. The hands may include any quantity of playing cards; in an optional embodiment, each hand includes two playing cards.

A hand score is calculated 104 for each hand by taking the sum modulo ten of the values of the playing cards in the hand. In an optional embodiment using conventional playing cards, the two through nine playing cards have a value equal to their face value, the Ace playing card has a value of one, and the ten, Jack, Queen, and King playing cards have a value of zero. As may be appreciated, the sum modulo ten means that if the sum exceeds ten, only the ones digit is used, with the tens digit disregarded. For example, the hand score for a hand of 8♧ 5♢, would be three.

In an optional embodiment, one or more natural hand scores may be defined. There may be any quantity of natural hand scores and the natural hand scores may take any value. In such an optional embodiment, a natural hand score occurs when a predefined sum modulo ten is obtained in the initial cards dealt to a hand. For example, in one optional embodiment, eight and nine are defined as natural hand scores. In such an optional embodiment, a hands of, for example, 4♡ 5♧(hand score of 9), 9♢ 9♡ (hand score of eight), 8♧ K♧ (hand score of eight), 9♢ J♤ (hand score of nine), 8♧ A♡ (hand score of nine), would all have natural hand scores.

In an optional embodiment, the hands are examined 106 for natural hand scores. If only one of the hands obtains a natural hand score, that hand wins; wagers on the hand with a natural hand score are rewarded 128 and wagers on the other hand(s) not having a natural hand score are collected. For example, if an "A" hand is dealt 8♧K♢ and a "B" hand is dealt 5♡9♢, the "A" hand of 8♧K♢ wins with a natural hand score of eight. Wagers on the "A" hand would be rewarded and wagers on the "B" hand would be collected.

In an optional embodiment, if more than one hand obtains a natural hand score, but the natural hand scores are unequal, the natural hand scores may be ranked so that the hands can be differentiated. Thus, in one such optional embodiment, a rule may be adopted in which the hand with the greater natural hand score wins; in such an optional embodiment, wagers on the hand with the higher ranking natural hand score are rewarded 128, 328 and wagers on the hand with the lower ranking natural hand score are collected. In one optional embodiment, the natural hand scores are ranked according to their proximity to the target value. Thus, in an optional embodiment in which nine is the target value, a natural hand score of nine may be ranked higher than a natural hand score of eight. For example, if an "A" hand is dealt 8♧K♢ and a "B" hand is dealt 5♡4♢, both hands have a natural hand score, but the "B" hand of 5♡4♢ wins with a natural hand score of nine against the "A" hand's natural hand score of eight. In an example where the natural hand score of nine outranks the natural hand score of eight, wagers on the "B" hand would be rewarded and wagers on the "A" hand would be collected. As may be appreciated, this is merely an example and the natural hand scores may be ranked in any order.

Optionally, if more than one hand has a natural hand score and the natural hand scores are equal 120, the tie could be resolved in many different ways. In one optional embodiment, shown in FIGS. 1-3, the tie is resolved as a push and wagers on tied hands are returned 124, 328. In another optional embodiment (not shown), the tie is resolved by examining the cards of the hands and using the card combination to differentiate between the tied hands. For example, if a hand is dealt with 8♧K♢ and another hand is dealt with 3♡5♢, one could identify one of the hands (for example, the hand containing a King) as a winning hand based on the constitution of the hand, even though both have a natural hand score of eight. In yet another optional embodiment (not shown), a showdown could occur by, for example, dealing an additional card to each hand and recalculating the hand scores to differentiate between the tied hands. For example, in the latter optional embodiment, if an "A" hand is dealt 5♡4♢ and a "B" hand is dealt 8♠A♡, one could deal one card to each hand to, for example, form the hands 5υ4♢ K♧ and 8♠A♡ 8♡. In such an example, the "A" hand 5♡4♢ K♧ wins with a hand score of nine against the "B" hand of 8♠A♡8♡ with a hand score of seven. Wagers on the "A" hand would be rewarded, while wagers on the "B" hand would be collected.

Referring generally to FIGS. 1-3, in an optional embodiment in which natural hand scores do not occur, the hand scores are compared to one another and a target value. In an optional embodiment, the target value is nine. In an optional embodiment using a target value of nine, the greater hand score will be closer to the target value than the lesser hand score. In the examples below, a target value of nine is used, although other target values could be used in alternate optional embodiments.

In an optional embodiment, if the hand scores for all the hands are less than a predetermined value, one or more additional playing cards may be dealt to each hand. For example, in an optional embodiment in which two hands are dealt, if both hands have a hand score less than, or equal to, a predetermined value such as two, an additional playing card may be dealt to each hand. In one such optional embodiment, a new hand score is calculated for each hand, and the new hand scores are compared to one another and the target value. Continuing with the example, wagers on the hand having a new hand score closer to the target value are rewarded and wagers on the hand or hands having a new hand score further from the target value may be collected. In the event that the new hand scores are equal, the game may be resolved by breaking the tie in a manner described below or the game may be resolved by returning the wagers on the hands having equal hand scores. Thus, in a game in which two hands are dealt, 4♠7♡ (for a hand score of one) and 2♢ K♠ (for a hand score of two), an additional playing card may be dealt to each hand since both hand scores are between zero and two, inclusive. If the additional card dealt to each hand results in hands of 4♠ 7♡10♧ (for a new hand score of one) and 2♢ K♠5♠ (for a new hand score of seven), wagers on the hand with a hand score of seven may be rewarded while wagers on the hand with a hand score of one may be collected.

Returning to FIGS. 1-3, if the hand scores are equal 108, the tie could be resolved in many different ways. For example, in an optional embodiment shown in FIG. 2, a tie could be resolved by returning 124 wagers on the tied hands. In another optional embodiment, shown in FIGS. 1 and 3, the tie could be resolved by dealing 122 an additional playing card to each tied hand and recalculating 130 the hand scores for the hands including the additional playing card. Based on these new hand scores, if the hands remain tied 132, the wagers may be returned 124, 326. If the hands are no longer tied, the wagers on the hand closer to the target value may be rewarded 126, 326 and the wagers on the hand further from the target value may be collected. For example, if an "A" hand is dealt 4♡Q♢ and a "B" hand is dealt 2♠2♡, the hand scores are tied at four. If, according to an optional embodiment, an additional card is dealt to each hand to form, for example, an "A" hand of 4♡ Q♢ 10♧ and a "B" hand of 2♠2♡Q♡, both hands remain tied and, in this example embodiment, the wagers on both hands may be returned, i.e. neither rewarded nor collected. If, however, an additional card is dealt to each hand to form, for example, an "A" hand of 4♡Q♢ 7♢ (for a hand score of one) and a "B" hand of 2♠2♡3♠ (for a hand score of seven), wagers on the "B" hand, which is closer to the target value of nine, will be rewarded, while wagers on the "A" hand will be collected.

Referring generally to FIGS. 1-3, if the hand scores are unequal 108, a card is dealt 110 to the hand further from the target value, e.g. the hand with the lesser hand score, and a new hand score is calculated 112 for that hand. If the new hand score is still further 116 from the target value, e.g. lesser than the other hand score, the wagers on the hand further from the target value, e.g. the lesser hand score, are collected and the wagers on the hand closer to the target value, e.g. the greater hand score, are rewarded 126, 326. For example, if an "A" hand is dealt 3♧8♢ (with a hand score of one) and a "B" hand is dealt A♠6♠ (with a hand score of seven), another card would be dealt to the "A" hand of 3♧8♢. If the card dealt to the "A" hand of 3♧8♢ is K♢, the new hand score for the "A" hand is one. In such an example, the "A" hand loses against to the "B" hand which is closer to the target value of nine with a hand score of seven. Wagers on the "B" hand would be rewarded and wagers on the "A" hand would be collected.

If the new hand score is closer 116 to the target value than is the other hand score, an additional playing card is dealt 110 to the hand further from the target value, e.g. the lesser hand score in this description, and a new hand score is calculated 112. The hand scores are compared to one another and the target value and wagers on the hand closer to the target value, e.g. the greater hand score, are rewarded 126 and wagers on the hand further from the target value, e.g. the lesser hand score, are collected. For example, if an "A" hand is dealt Q♡ 6♠ (for a hand score of six) and a "B" hand is dealt 8♢ 6♢ (for a hand score of four), an additional playing card is dealt to the "B" hand. If the resulting "B" hand is 8♢ 6♢ 3♧ (for a hand score of seven), the hand score for the "B" hand is now closer to a target value of nine than is the hand score for the "A" hand. In this optional embodiment, an additional card would be dealt to the "A" hand. If the resulting dealt gives an "A" hand of Q♡ 6♠ K♧ (for a hand score of six), this is compared to the "B" hand of 8♢ 6♢ 3♧ (with a hand score of seven), and the "B" hand is the winning hand with the hand score closer to nine. Wagers on the "B" hand would be rewarded and wagers on the "A" hand would be collected.

It is noted that in this optional embodiment, the steps of dealing a playing card to the hand further from the target value and calculating a new hand score are limited by the maximum number 118 of playing cards that may be dealt to a hand. In other words, in this example, the hand initially further from the target value receives a third card and, if the third card causes the hand to become closer to the target value, the process is repeated for the other hand since it is now further from the target value. In this example, this process can only be performed once for each hand, since the hand initially contains two playing cards and the maximum number of playing cards in a hand in this example is three. However, it is contemplated that the maximum number could be any quantity, so that the process of dealing to the further hand, and recalculating the hand scores, could be repeated any desired number of times.

If the new hand score is equal 114 to the other hand score, the tie can be resolved in many different ways. For example, in one optional embodiment shown in FIGS. 1 and 2, the tie can be resolved as a push with all wagers returned 124. In other words, in such an optional embodiment, wagers on the hands are neither rewarded nor collected, but returned to the players placing them.

In another optional embodiment shown in FIG. 3, the tie can be resolved by dealing a card to the hand that previously did not receive a card, i.e. the "other" hand in this description. A new hand score is calculated 112 for the hand to which an additional card is dealt. Wagers on the hand further from the target value, e.g. the lesser hand score, are collected 326 and wagers on the hand closer to the target value, e.g. the greater hand score, are rewarded. In this latter example, if an "A" hand is dealt 4♢ K♧ and a "B" hand is dealt 2♧ 5♤, the "A" hand is dealt another card since its hand score of four further from the target value than is the "B" hand score of seven. If the result of the deal is an "A" hand of 4♢ K♧ 3♢, the new hand score for the "A" hand is seven, which ties the "B" hand score. In this optional embodiment, an additional card may be dealt to the hand not previously receiving a card, e.g. the "B" hand. If the card dealt results in a "B" hand of 2♧ 5♤ 8♡, the new hand score for the "B" hand is five. This hand score of five is compared to the "A" hand of 4♢ K♧ 3♢, which has a new hand score of seven, and the tie is resolved in favor of the "A" hand which is now closer to the target value of nine than the "B" hand is. Wagers on the "A" hand would be rewarded and wagers on the "B" hand would be collected.

Wagers may be rewarded in any manner. In an optional embodiment, wagers are rewarded at even money. In a further optional embodiment, rewards are assessed a commission. In one optional embodiment, the commission amount is a fixed amount, optionally expressed as a percentage of the reward. For example, in one such optional embodiment, a commission of 5% may be assessed on all rewards, without regard to the hand wagered upon.

In another optional embodiment, the commission amount is a variable amount. The varying amount of the commission may be based on many different factors, including the hand score of the winning hand, the hand score of the losing hand, the difference between the hands scores, or any other measure. For example, in one optional embodiment, the commission varies depending on the hand score of the winning hand, with rewards on winning hands are paid at even money, with hands winning with hand scores of seven, eight, or nine assessed a 5% commission and hands winning with any other hand scores paid commission-free. In another optional embodiment, rewards may be paid at even money, with hands winning with a hand score of four assessed a 50% commission and hands winning with any other hand scores paid commission-free. As may be appreciated, any combination of hand scores and commissions may be used. Some other examples include assessing winning hands with hand scores six, seven, or eight a 5% commission; assessing winning hands with hand scores eight or nine a 5% commission; or assessing winning hands with a hand score of five a 50% commission. It is noted that a consideration in selecting criteria for a commission may include the effect on the house edge of the commission.

While certain embodiments of the present invention have been shown and described it is to be understood that the present invention is subject to many modifications and changes without departing from the spirit and scope of the invention presented herein.

I claim:

1. A method of conducting a card game at a physical gaming table using playing cards for at least one player comprising:

receiving a wager from said at least one player on a hand designated by said player;

dealing at least two hands of playing cards;

calculating a hand score for each hand as the sum modulo ten of the values of the playing cards in that hand;

comparing the hand scores of said hands to a target value;

if one of said hand scores is closer to said target value than is the other hand score, dealing an additional card to the hand having a hand score further from said target value, calculating a new hand score for said hand to which said card was dealt, and comparing the hand scores of said hands to said target value;

if said new hand score remains further from said target value than is the hand score for the other hand, terminating said card game, collecting wagers on the hand having a hand score further from said target value, and rewarding wagers on the hand having a hand score closer to said target value; and if said new hand score is closer to said target value than is the hand score for the other hand, dealing an additional card to the hand having a hand score further from said target value, calculating a new hand score for said hand to which the card was dealt, comparing said hand scores to said target value, and terminating said card game by collecting wagers on the hand having a hand score further from said target value and rewarding wagers on the hand having a hand score closer to said target value.

2. The method of claim 1 further comprising, if said hand scores are equal, dealing an additional card to each hand, calculating a new hand score for each hand, comparing said new hand scores to said target value, and collecting wagers on the hand further from said target value and rewarding wagers on the hand closer to said target value.

3. The method of claim 1 further comprising, if said hand scores are equal, returning said wagers.

4. The method of claim 1 wherein said step of rewarding comprises issuing a reward based on said wager, minus a commission.

5. The method of claim 4 wherein said commission is a percentage of said reward that varies based on the hand score closer to said target value.

6. The method of claim 1 further comprising:

defining at least one natural hand score;

if only one of the hand scores is a natural hand score, rewarding wagers on said hand having a natural hand score and collecting wagers on said hand not having a natural hand score;

if more than one of the hand scores is a natural hand score and one of the natural hand scores is greater than the other natural hand score, rewarding wagers on said hand having a natural hand score closer to said target value and collecting wagers on said hand having a natural hand score further from said target value; and if more than one of the hand scores is a natural hand score and the natural hand scores are equal, returning all wagers.

7. The method of claim 1 further comprising if said new hand score is equal to the hand score for the other hand, returning all wagers.

8. The method of claim 1 further comprising if said new hand score is equal to the hand score for the other hand, dealing an additional card to the other hand, calculating a new hand score for the other hand, comparing said new hand scores to said target value, and collecting wagers on the hand with the new hand score further from said target value and rewarding wagers on the hand with the new hand score closer to said target value.

9. The method of claim 1 further comprising, if each hand score for said hands is less than a predetermined value, dealing at least one additional card to each hand, calculating a new hand score for each said hand, and comparing said new hand scores of said hands to said target value.

10. A method of conducting a card game at a physical gaming table using playing cards for at least one player comprising:

defining at least one natural hand score;

receiving a wager from said at least one player on a hand designated by said player;

dealing at least two hands of playing cards;

calculating a hand score for each hand as the sum modulo ten of the values of the playing cards in that hand;

comparing the hand scores of said hands to one another and to a target value;

if only one of the hand scores is a natural hand score, terminating said card game, rewarding wagers on said hand having a natural hand score, and collecting wagers on said hand not having a natural hand score;

if more than one of the hand scores is a natural hand score and one of the natural hand scores is greater than the other natural hand score, terminating said card game, rewarding wagers on said hand having a natural hand score closer to said target value, and collecting wagers on said hand having a natural hand score further from said target value;

if more than one of the hand scores is a natural hand score and the natural hand scores are equal, terminating said card game and returning all wagers; and if none of the hand scores is a natural hand score, resolving said wagers, said resolution comprising:

if said hand scores are equal, dealing an additional card to each hand, calculating a new hand score for each hand, comparing said new hand scores, and terminating said card game by collecting wagers on the hand with the new hand score further from said target value and rewarding wagers on the hand with the new hand score closer to said target value;

if one of said hand scores is further from said target value than is the other hand score, dealing an additional card to the hand having a hand score further from said target value, calculating a new hand score for said hand to which said card was dealt, and comparing the hand scores of said hands to said target value;

if said new hand score is remains further from said target value than is the hand score for the other hand, terminating said card game. collecting wagers on the hand with a hand score further from said target value, and rewarding wagers on the hand with the hand score closer to said target value; and if said new hand score is closer to said target value than is the hand score for the other hand, dealing an additional card to the hand having the hand score further from said target value, calculating a new hand score for said hand to which the card was dealt, comparing said hand scores, and terminating said card game by collecting wagers on the hand with the hand score further from said target value and rewarding wagers on the hand with the hand score closer to said target value.

11. The method of claim 10 wherein said step of rewarding comprises issuing a reward based on said wager, minus a commission.

12. The method of claim 11 wherein said commission is a percentage of said reward that varies based on said hand score closer to said target value.

13. The method of claim 10 further comprising if said new hand score is equal to the hand score for the other hand, returning all wagers.

14. The method of claim 10 further comprising if said new hand score is equal to the hand score for the other hand, dealing an additional card to the other hand, calculating a new hand score for the other hand, comparing said new hand scores, and collecting wagers on the hand with the new hand score further from said target value and rewarding wagers on the hand with the new hand score closer to said target value.

15. The method of claim 10 further comprising, if each hand score for said hands is less than a predetermined value, dealing at least one additional card to each hand, calculating a new hand score for each said hand, and comparing said new hand scores of said hands to said target value.

16. A method of conducting a card game at a physical gaming table using playing cards for at least one player comprising:

defining at least two natural hand scores;

receiving a wager from said at least one player on a hand designated by said player;

dealing two hands of playing cards;

calculating a hand score for each hand as the sum modulo ten of the values of the playing cards in that hand;

comparing the hand scores of said hands to one another and to a target value;

if only one of the hand scores is a natural hand score, terminating said card game, rewarding wagers on said hand having a natural hand score, and collecting wagers on said hand not having a natural hand score;

if more than one of the hand scores is a natural hand score and one of the natural hand scores is closer to said target value than is the other natural hand score, terminating said card game, rewarding wagers on said hand having a natural hand score closer to said target value, and collecting wagers on said hand having a natural hand score further from said target value;

if both of the hand scores is a natural hand score and the natural hand scores are equal, terminating said card game and returning all wagers; and if neither of the hand scores is a natural hand score, resolving said wagers, said resolution comprising:

if said hand scores are equal, dealing an additional card to each hand, calculating a new hand score for each hand, comparing said new hand scores, and terminating said card game by collecting wagers on the hand with the new hand score further from said target value and rewarding wagers on the hand with the new hand score closer to said target value;

if one of said hand scores is further from said target value than is the other hand score, dealing an additional card to the hand having the hand score further from said target value, calculating a new hand score for said hand to which said card was dealt, and comparing the hand scores of said hands to said target value;

if said new hand score remains further from said target value than is the hand score for the other hand, terminating said card game, collecting wagers on the hand with the hand score further from said target value and rewarding wagers on the hand with the hand score closer to said target value; and if said new hand score is closer to said target value than is the hand score for the other hand, dealing an additional card to the hand having the hand score further from said target value, calculating a new hand score for said hand to which the card was dealt, comparing said hand scores, and terminating said card game by collecting wagers on the hand with the hand score further from said target value and rewarding wagers on the hand with the hand score closer to said target value.

17. The method of claim 16 wherein said step of rewarding comprises issuing a reward based on said wager, minus a commission.

18. The method of claim 17 wherein said commission is a percentage of said reward that varies based on said hand score closer to said target value.

19. The method of claim 16 further comprising if said new hand score is equal to the hand score for the other hand, returning all wagers.

20. The method of claim 16 further comprising if said new hand score is equal to the hand score for the other hand, dealing an additional card to the other hand, calculating a new hand score for the other hand, comparing said new hand scores, and collecting wagers on the hand with the new hand score further from said target value and rewarding wagers on the hand with the new hand score closer to said target value.

21. The method of claim 16 further comprising, if each hand score for said hands is less than a predetermined value, dealing at least one additional card to each hand, calculating a new hand score for each said hand, and comparing said new hand scores of said hands to said target value.

* * * * *